US006075503A

United States Patent [19]

Biverot

[11] Patent Number: 6,075,503

[45] Date of Patent: Jun. 13, 2000

[54] IMAGE PRESENTATION METHOD AND ARRANGEMENT

[75] Inventor: Hans Biverot, Hässelby, Sweden

[73] Assignee: CelsiusTech Electronics AB, Jarfalla, Sweden

[21] Appl. No.: 09/043,860

[22] PCT Filed: Oct. 9, 1996

[86] PCT No.: PCT/SE96/01281

§ 371 Date: Mar. 27, 1998

§ 102(e) Date: Mar. 27, 1998

[87] PCT Pub. No.: WO97/14136

PCT Pub. Date: Apr. 17, 1997

[30] Foreign Application Priority Data

Oct. 9, 1995 [SE] Sweden ..... 9503503

[51] Int. Cl.[7] ..... G09G 5/00

[52] U.S. Cl. ..... 345/8; 345/7

[58] Field of Search ..... 345/7, 8, 9, 30, 345/32, 31, 4, 5, 6; 348/51, 52, 53, 54, 55, 56, 57, 58, 59, 60

[56] References Cited

U.S. PATENT DOCUMENTS 5,327,153 7/1994 Biverot ..... 345/5
5,467,104 11/1995 Furness, III et al. ..... 345/8
5,574,473 11/1996 Sekiguchi ..... 345/32
5,596,339 1/1997 Furness, III et al. ..... 345/8
5,635,947 6/1997 Iwamoto ..... 345/8
5,703,637 12/1997 Miyazaki et al. ..... 345/8

FOREIGN PATENT DOCUMENTS 500 061 of 1994 Sweden .

*Primary Examiner*—Xiao Wu
*Attorney, Agent, or Firm*—Pollock, Vande Sande & Amernick

[57] ABSTRACT

A method of presenting a complete image on a retina of an observer. The image is built-up of a large number of pixels located along mutually adjacent lines on the retina of the observer by utilizing at least one line on a display which is separated from the observer and which consecutively shows the pixels in all lines of the image to be built up and presented on the retina of the observer, by deflecting the line shown on the display over the whole of the image-perceiving surface of the retina utilizing a line deflection movement which is non-linear in time, and by compensating for image distortion caused by the non-linear deflection.

32 Claims, 6 Drawing Sheets

IMAGE PRESENTATION METHOD AND ARRANGEMENT

FIELD OF THE INVENTION

The present invention relates to a method of presenting a complete image on the retina of an observer. The image is built-up of a large number of pixels located along mutually adjacent lines starting from at least one line on a display which consecutively shows the pixels in all lines of the image. The line shown on the display is deflected over the whole of the image-perceiving surface of the retina. By image-perceiving surface is meant the area of the retina which sees the image display. The invention also relates to a system for use when carrying out the method.

BACKGROUND OF THE INVENTION

Swedish Patent Specification No. 910778-0 describes a system which can be used to present images with the aid of this principle, among other things. The patent specification describes generally a system for presenting an image on the basis of at least two variables for each pixel, such as pixel position and pixel information. The image is thus comprised of a plurality of pixels, each defined by a pixel position given by two angular coordinates in relation to a reference direction from the observer, and by information relating to each pixel with regard to intensity, color, polarization, etc., at each moment in time.

The novel principle disclosed in the aforesaid patent specification enables the image presentation system, or display, to be divided into two parts. More specifically, the system or display may be divided into a first display device located at a distance from the observer, and a second display device located in the field of view between the observer and the first display device. It is also necessary for the presentation system to include means for mutually synchronizing the first and the second display devices.

According to the aforesaid patent specification, when imaging with the aid of two mutually separate display devices, these devices can be provided with different combinations of the three variables X-coordinate, Y-coordinate and pixel information, such as intensity, color, polarization, etc. A total of six combinations are possible for dividing these variables between the two display devices.

SUMMARY OF THE INVENTION

The present invention is concerned with simplifications to the equipment required with some of these combinations, particularly those combinations in which the display device which is located at a distance from the observer is provided with information relating to the X-coordinate of respective pixels, with or without pixel information. This display device will thus display a line which consecutively shows the pixels in all lines of the image or picture. The line may be orientated in desired directions and be comprised of uniformly illuminated pixels or pixels that contain information relating to intensity, color, polarization, etc. This display can thus be a so-called line display. The display may also be constructed for simultaneous presentation of one or more groups of preferably mutually adjacent lines.

It is therewith necessary to provide the second display device, which is conveniently carried by the observer in the form of spectacles (goggles) through which the line display can be viewed, with means for deflecting the observed line or lines in the opposite direction, which is suitably perpendicular to the propagation of the line, so that a complete image will be "painted" over the retina of the observer. It is thus only on the retina that the image exists in its entirety as a mean value formulation over a maximum time period corresponding to the slowness or integration time of the eye.

In the case of present-day standard video formats in TV-technology, the image, or half-image, is normally generated in so-called interlace format, line-by-line uniformly in time.

In the case of a deflecting means based on a mirror periscope, for instance, in which a mirror is caused to oscillate in time with requisite line-by-line deflection, it is necessary for the mirror to move linearly with time during each image sweep. The time to the next image or half-image is extremely short, and the oscillatory movement of the mirror will therefore preferably correspond ideally to a ramp function having a short fly-back time; see FIG. 1A. This movement is difficult to achieve from a mechanical aspect, and requires movement of the mirror to be accelerated markedly at its end positions. If such a deflecting means were to be used in spectacles, the necessary construction would be highly complicated and difficult to achieve.

In the case of mirror deflection, it is somewhat simpler to use a movement that corresponds to that of a pure triangular wave; see FIG. 1B. If desired, each part-ramp during one period can be used for its individual sweep, although this would require reversed reading of the pixel information during one ramp and corresponding precision between the mutual adjustment of the half-images. Alternatively, each alternate part-period can be omitted. Another alternative is to present each alternate part-image to the left eye of the observer and each other alternate part-image to the right eye, therewith generating stereoimage pairs, for instance, which requires the use of an image separation mechanism, such as polarized light, color or synchronized shutters at each eye.

The main object of the present invention is to provide an image presentation method and an image presentation system in accordance with the aforegoing which enable the use of simpler deflecting movement for the line or one or more bands of lines shown on a display.

This method is achieved in accordance with the present invention with a method of the kind defined above which is characterized by using a line deflecting movement which is non-linear in time, and by compensating for the distortion of the image caused by this non-linear deflection.

When using a mirror, for instance, this will enable the mirror to oscillate or swing in accordance with a simple harmonic sinusoidal function, among other things, see FIG. 1C, which is relatively easy to achieve. When the lines are therewith triggered at constant time intervals during the full oscillating cycle of the mirror, as in the case of conventional technology, the distances between the lines in the deflection direction on the observer's retina will vary and the image will be perceived as though lying on the projection of a cylindrical surface. This effect must be compensated for at least partially when applying the invention.

This can be achieved in different ways. According to a first method, the lines can be triggered at different time intervals, so that the physical distance between the lines in the deflecting direction on the observer's retina will be essentially constant.

Alternatively, when the requirement of image quality is lower, there can be used a simpler technical solution in which the lines are only triggered during those parts of the oscillating movement which run relatively linearly with time. An essentially constant physical distance between the lines reproduced on the observer's retina can also be achieved in this way.

Instead of a time-wise compensation of a sinusoidal movement in accordance with the aforegoing, a purely optical distortion of the deflection of the line can be used, for instance with the aid of a cylindrical-type lens or mirror system which will result in an essentially constant physical distance between the lines in the direction in which the lines are deflected onto the observer's retina.

Other features of the inventive method and features of a invention system for carrying out the method will be apparent from the following.

BRIEF DESCRIPTION OF THE DRAWINGS

The invention will now be described in more detail with reference to exemplifying embodiments thereof and also with reference to the accompanying drawings, in which.

DETAILED DESCRIPTION OF THE INVENTION

Figure 2:
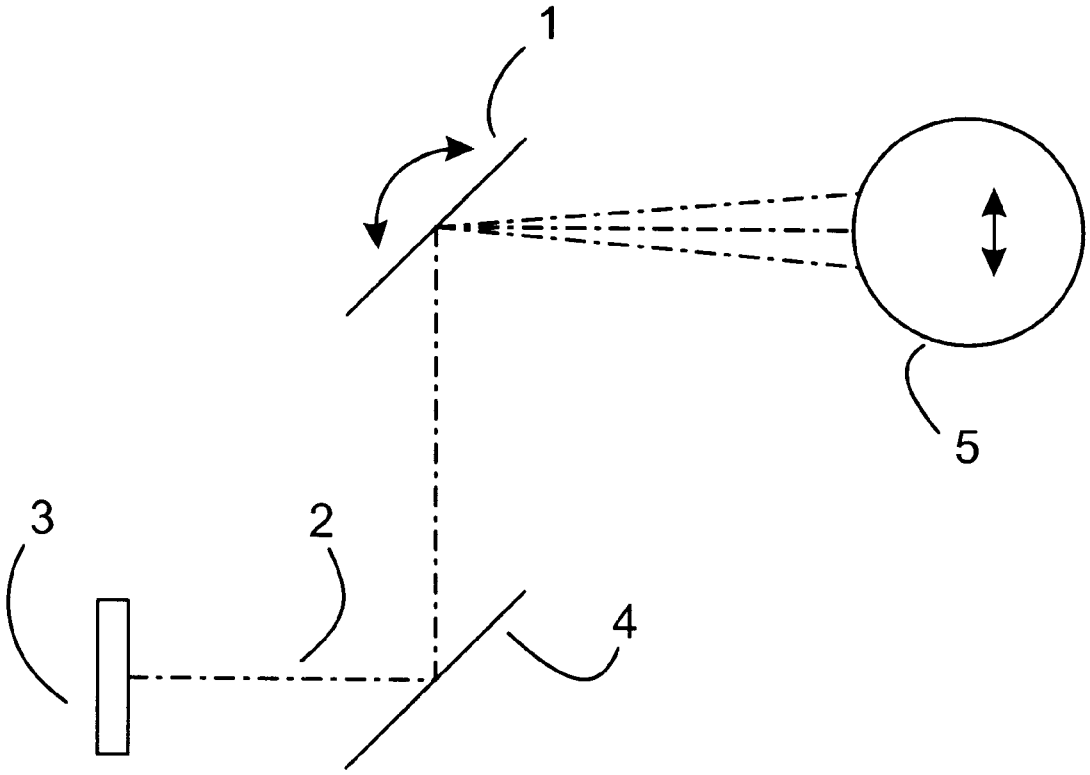
FIG. 2 illustrates schematically the use of a mirror periscope in which the deflecting means has the form of an oscillating mirror.

FIG. 2 illustrates schematically the principle of a deflecting arrangement that can be used in the second display presentation device in a system according to our aforesaid Swedish Patent No. 910778-0. The display device may, for instance, have the form of spectacles that include a mirror periscope having an oscillating mirror 1 for each eye. The reference numeral 2 identifies the light beams incoming from a line on a line display 3, said beams being reflected onto the oscillating mirror 1 by a fixed mirror 4. The oscillating mirror 1 deflects the line represented by the parallel light beams 2 vertically over the retina of the eye 5. The oscillatory movement of the mirror 1 is synchronized with the presentation of consecutive lines in the image on the line display 3. The original image will, in this way, be "painted" over the retina during one half-period of the oscillating movement of the mirror. Optionally, only one so-called half-image in interlace format may be created during each half-period. A flutter-free image is obtained when only one image field is presented during the integration time of the eye, which is normally in the order of 10–20 ms.

Figure 1A:
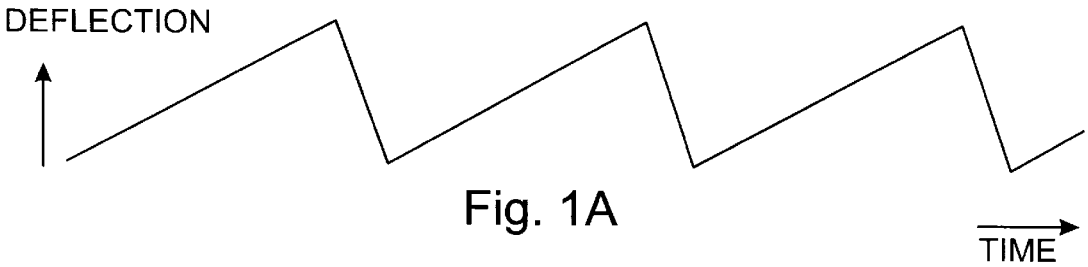
FIGS. 1A–C illustrate the aforementioned types of oscillatory movement.
Figure 1B:
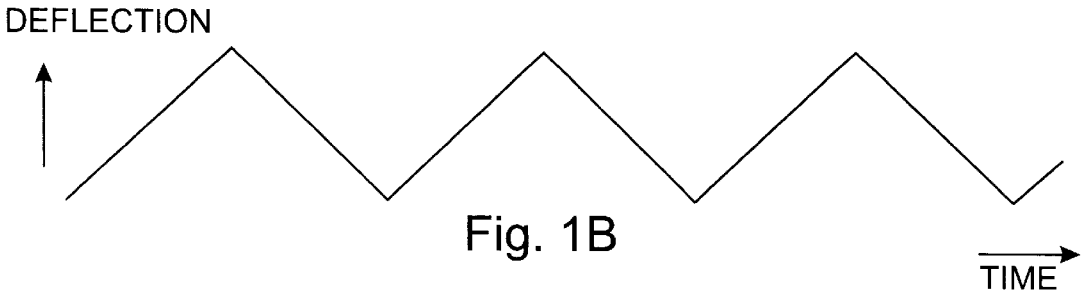
Figure 1C:
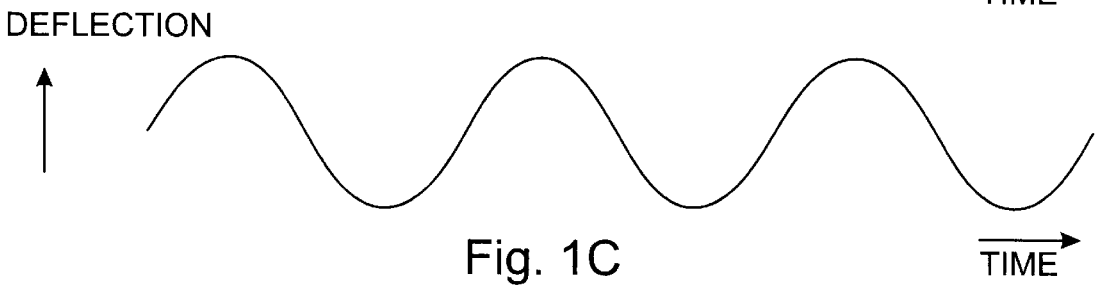

In order to enable the use of simple and inexpensive spectacles, it is necessary to use the simplest possible movement with respect to the movable mirror. The use of linear ramp functions of the type illustrated in FIGS. 1A and 1B complicate the construction by virtue of requiring high accelerations at the positions in which oscillatory movement of the mirror changes direction. It is much simpler to produce spectacles in which harmonic mirror movement is employed, for instance with the aid of a mechanical oscillator in resonance provided with amplitude stabilization. In this regard, the mirror may be balanced by a counterweight which oscillates in time with the mirror, so that the wearer will experience the least possible vibrations. The centre of gravity of the oscillating system will thus preferably be static during oscillatory movement of the mirror.

Figures 3A, 3B:
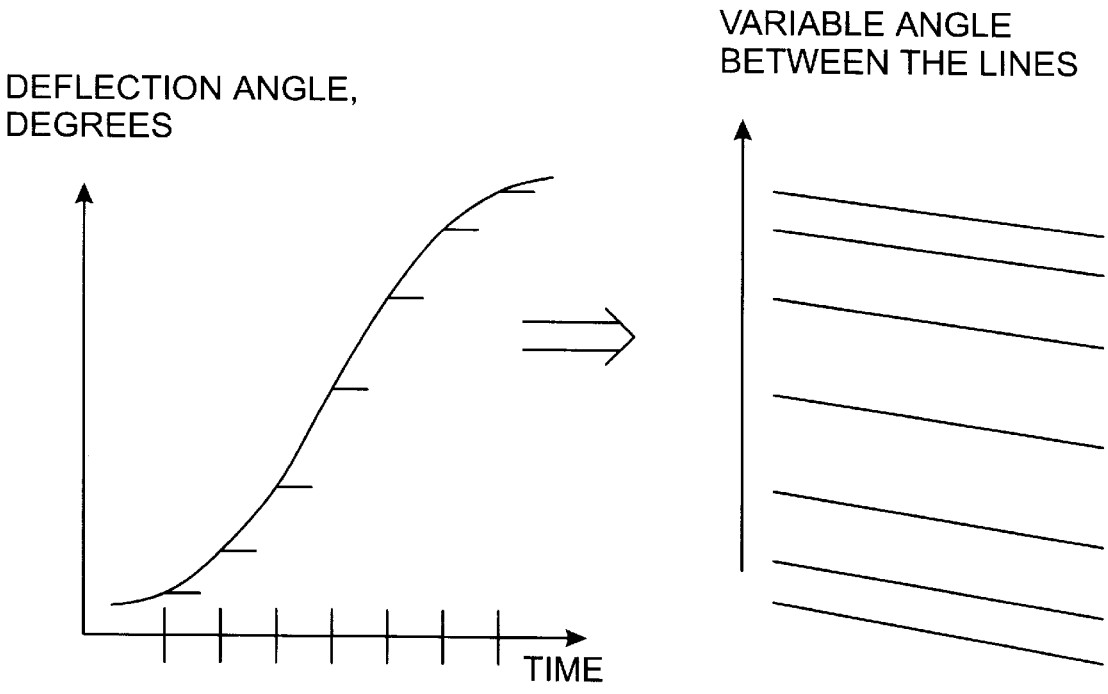
FIGS. 3A–B illustrate the result obtained when mirror oscillation corresponds to a sinusoidal function and the lines that build-up the image are triggered at constant time intervals.

FIG. 3A illustrates the oscillatory movement of the mirror 1 in degrees as a function of time, when the oscillatory movement corresponds to a sinusoidal function.

In conventional TV-technology, the deflecting voltage is linear with time and triggering of the liens is effected at mutually constant time intervals. When this technique is applied with a non-linear deflecting movement in accordance with FIG. 3A, the angle between the lines will vary over the image-perceiving area of the retina, see FIG. 3B. This would result in unacceptable distortion of the image.

Figure 4A:
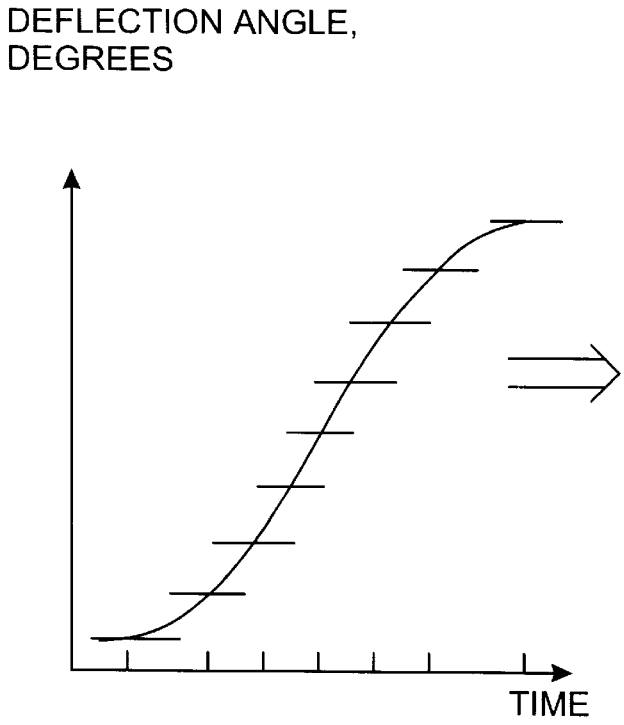
FIGS. 4A–B illustrate the result obtained when mirror oscillation corresponds to a sinusoidal function and the lines that build-up the image according to a first embodiment of the invention are triggered at varying time intervals.

FIG. 4A illustrates a first method of compensating for the effect of using non-linear deflecting movement of the mirror 1 shown in FIG. 3, in accordance with the present invention. Similar to the earlier case, the FIG. 4A embodiment also utilizes sinusoidal oscillatory movement of the movable mirror 1. In the case of this embodiment, the line display drive circuits are constructed to trigger the various lines at varying time intervals, as marked along the time axis in FIG. 4A.

Figure 4B:
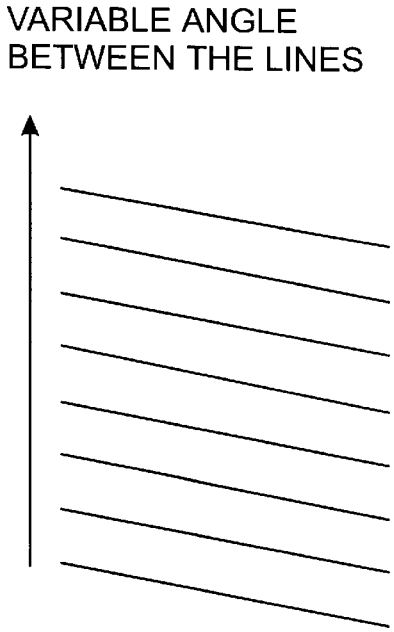

These time intervals are chosen so that the mirror 1 is able to swing through the same number of degrees between each line triggering occasion. As illustrated in FIG. 4B, this means that the angle between the lines in the complete image will be essentially constant over the whole of the image surface. This results in an image of high quality of the retina of the eye, this image optionally being built-up of half-images in interlace format as in the earlier case.

Figures 5A, 5B:
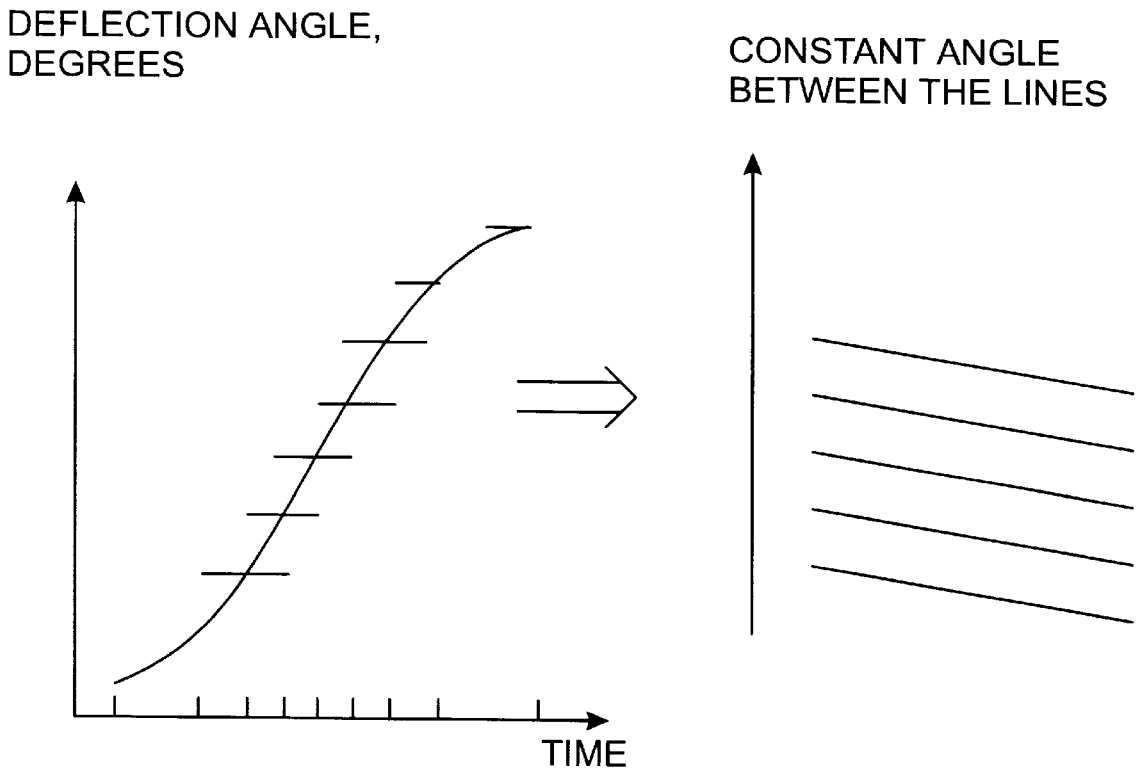
FIGS. 5A–B illustrate the result obtained when mirror oscillation corresponds to a sinusoidal function and the lines that build-up the image according to a second embodiment of the invention are triggered solely during that part of the oscillating movement that runs relatively linearly with time.

The technique illustrated in FIG. 5A can be used when the requirement of image quality is slightly lower. In this case, the lines that are to be presented on the retina are only triggered during the relatively linear part of the flanks of the sinusoidal curve. This can result in cutting of the image at the top and the bottom thereof. This is unimportant in certain cases however. Alternatively, the triggering time points for all lines may be distributed solely along the essentially linear part of the curve. The turning points of the mirror will therewith correspond to blanking intervals in the line generator.

Figure 6:
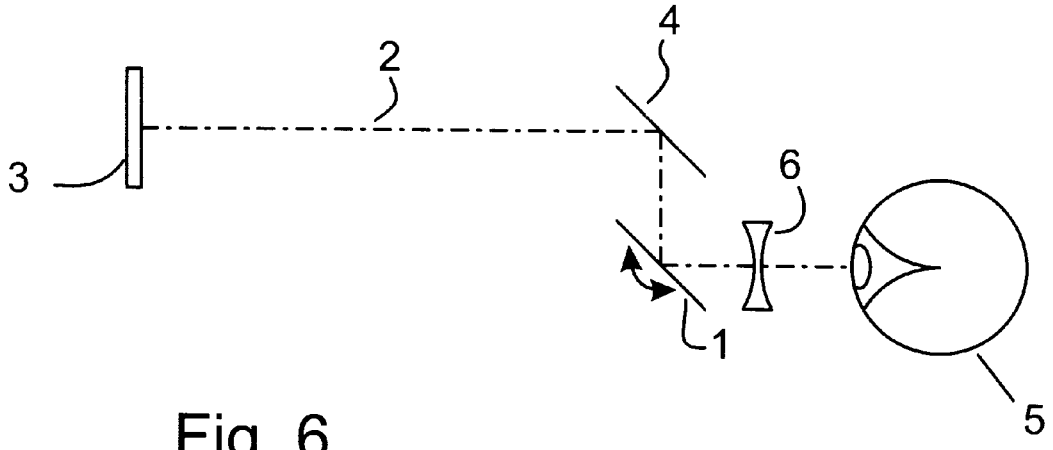
FIG. 6 illustrates schematically a method of optically compensating for the undesirable deflection effects obtained as a result of non-linear movement of the mirror in time, in accordance with a third embodiment of the invention.

Optical distortion of the beam deflected by the mirror may be used as an alternative to time-wise compensation of the sinusoidal movement of the mirror. As illustrated in FIG. 6, this can be achieved with the aid of a cylinder-type optical lens 6 or a cylinder-type mirror system, for instance.

With lenses or mirrors of this nature, the light beam deflected towards the eye can be further deflected by the lens or mirror system 6 so as to compensate for the retardation of mirror movement at the mirror turning points. An essentially constant physical distance between the lines in the deflection direction on the retina of the eye can also be achieved in this way.

The aforedescribed principle solutions to the problem which the invention is intended to solve can be realized in different ways known to the person skilled in this art. For instance, instead of a display driven by an electron beam, the line display 3 may be a display in which each pixel is comprised of a light-emitting diode or the like. The display may be adapted to show one single line or one or more bands of lines activated in parallel. The line pixels may therewith be activated in parallel instead of sequentially.

The intensity, colors, polarization, etc., of each line pixel may be modulated, wherein corresponding information can be delivered from a shift register or the like. Alternatively, the line may be comprised of uniformly illuminating pixels, wherein the information in each pixel is supplied in the second display device or presentation device located nearest the observer.

When both flanks of a sinusoidal oscillatory movement of the mirror are to be used to deflect the beam, it is necessary to read the information for each pixel in different directions during the two parts of an oscillatory period. Alternatively, both flanks can be used to present different information to both eyes of the observer, thereby enabling a stereoscopic image to be presented to the observer. Triggering of the lines on the display at desired time points can be readily achieved with the aid of drive circuits known to the person skilled in this art.

The invention has been described in the aforegoing with reference to a line written in the X-direction. The principle is the same, however, irrespective of the direction in which the lines are written, provided the second display means deflects the line in a second direction, normally a direction which is perpendicular to the first direction. Thus, the display can show, for instance, a vertical line which is propagated horizontally by the mirror over the image-perceiving area of the retina. The first display device may also be provided with information concerning the Y-coordinate of respective pixels, wherein deflection in the X-direction takes place in the display device in the immediate proximity of the observer.

As before mentioned, the deflecting means can be conveniently incorporated in a pair of spectacles. Naturally, if desired, only a single deflecting means may be used for both eyes and incorporated in a cyclops-like system. Alternatively, the system may have the form of a monocle.

As an alternative to the aforedescribed mirror-periscope, deflection may, of course, be achieved with the aid of any other suitable opto-mechanical device that describes a suitable oscillatory movement, such as rotating wedges. Furthermore, electro-optical modulators may also be used, for instance. The sinusoidal oscillation referred to in the example may be replaced with another harmonic oscillation, or a combination of such oscillations may be employed.

What is claimed is:

1. A method of presenting a complete image on a retina of an observer, said image being built-up of a large number of pixels located along mutually adjacent lines on the retina of the observer by utilizing at least one line on a display which is separated from the observer and which consecutively shows the pixels in all lines of the image to be built up and presented on the retina of the observer, by deflecting the line shown on the display over the whole of the image-perceiving surface of the retina utilizing a line deflection movement which is non-linear in time, and by compensating for image distortion caused by the non-linear deflection.

2. The method according to claim 1, wherein the line deflection movement comprises at least one harmonic oscillation, and wherein the compensating comprises triggering the lines at different time intervals such that a physical distance between the lines in a direction of the deflection movement onto the retina of the observer will be essentially constant.

3. The method according to claim 2, wherein the at least one harmonic oscillation comprises an harmonic sinusoidal oscillation.

4. The method according to claim 2, wherein the at least one harmonic oscillation comprises a combination of harmonic oscillations.

5. The method according to claim 1, wherein the line deflection movement comprises at least one harmonic oscillation, and wherein the compensating comprises triggering the lines only during temporally linear parts of the oscillation, such that a physical distance between the lines deflected over the retina of the observer will be essentially constant.

6. The method according to claim 5, wherein the at least one harmonic oscillation comprises an harmonic sinusoidal oscillation.

7. The method according to claim 5, wherein the at least one harmonic oscillation comprises a combination of harmonic oscillations.

8. The method according to claim 1, wherein the line deflection movement comprises at least one harmonic oscillation, and wherein the compensating comprises optically distorting deflection of the lines such that a physical distance between the lines in the deflection direction onto the observer's retina will be essentially constant.

9. The method according to claim 8, wherein the at least one harmonic oscillation comprises an harmonic sinusoidal oscillation.

10. The method according to claim 8, wherein the at least one harmonic oscillation comprises a combination of harmonic oscillations.

11. The method according to claim 8, wherein the optically distorting deflection is carried out with a cylindrical lens or mirror system.

12. The method according to claim 1, wherein the line deflection comprises a cyclic oscillatory movement utilized for two active deflecting movements of the line with each cycle in mutually opposite directions.

13. The method according to claim 12, wherein deflection of the line during a first half of a cycle is directed to a first eye of the observer and deflection of the line during a second half of the cycle is directed to a second eye of the observer.

14. The method according to claim 12, wherein at least one group of mutually adjacent lines presented on the display is simultaneously deflected.

15. The method according to claim 12, wherein the deflection is effected with the at least one oscillating mirror for each eye, the mirrors being mounted on a structure worn by the observer through which the display is observed.

16. The method according to claim 15, wherein the observer-worn structure comprises spectacles or goggles.

17. A system for presenting a complete image comprising a plurality of pixels located along mutually adjacent lines on the retina of an observer, the system comprising:

a display separated from the observer, at least one line on the display consecutively showing the pixels in all lines of the image to be built up and presented on the retina;

deflecting means for deflecting the line presented on the display over all of a display-discerning area of the retina, the deflecting means utilizing a temporally non-linear line deflection movement; and means for compensating for distortion of the image caused by the non-linear deflection.

18. The system according to claim 17, wherein the line deflection movement comprises at least one harmonic oscillation, and wherein the compensating means comprises means for temporally controlling triggering the lines, such that a physical distance between the lines in a direction of the deflection movement onto the retina of the observer will be essentially constant.

19. The system according to claim 18, wherein the at least one harmonic oscillation comprises an harmonic sinusoidal oscillation.

20. The system according to claim 18, wherein the at least one harmonic oscillation comprises a combination of harmonic oscillations.

21. The system according to claim 17, wherein the line deflection movement comprises at least one harmonic oscillation, and wherein the compensating means comprises means for temporally controlling triggering the lines, such that triggering will only occur during relatively temporally linear parts of the oscillating movement, such that a physical distance between the lines deflected over the retina of the observer will be essentially constant.

22. The system according to claim 21, wherein the at least one harmonic oscillation comprises an harmonic sinusoidal oscillation.

23. The system according to claim 21, wherein the at least one harmonic oscillation comprises a combination of harmonic oscillations.

24. The system according to claim 17, wherein the line deflection movement comprises at least one harmonic oscillation, and wherein the compensating means comprises means for optically distorting deflection of the line such that the physical distance between the lines in the direction of the deflection onto the observer's retina will be essentially constant.

25. The system according to claim 24, wherein the optical distorting means comprises a cylinder-type lens or mirror system.

26. The system according to claim 24, wherein the at least one harmonic oscillation comprises an harmonic sinusoidal oscillation.

27. The system according to claim 24, wherein the at least one harmonic oscillation comprises a combination of harmonic oscillations.

28. The system according to claim 17, wherein the display is adapted to present at least one group of mutually adjacent lines, and wherein the deflecting means simultaneously deflects all lines presented on the display.

29. The system according to claim 17, wherein the deflecting means comprises at least one oscillating mirror.

30. The system according to claim 17, further comprising:

a structure worn by the observer through which the display is observed.

31. The system according to claim 30, wherein the observer-worn structure comprises spectacles or goggles.

32. A method of presenting a complete image built up of a plurality of pixels located along mutually adjacent lines on a retina of an observer, comprising:

consecutively showing the plurality of pixels in all lines of the image to be built up on the retina of the observer utilizing at least one line on a display that is separated from the observer;

deflecting th line shown on the display over the whole of the image perceiving surface of the retina utilizing a temporally non-linear line deflection movement; and compensating for image distortation caused by the temporally non-linear deflection.

* * * * *